US011752069B2

(12) United States Patent
Inamori et al.

(10) Patent No.: US 11,752,069 B2
(45) Date of Patent: Sep. 12, 2023

(54) METHOD FOR TRANSFERRING CELLULAR MEDICINE USING A CELLULAR MEDICINE TRANSFER SYSTEM

(71) Applicants: HEALIOS K. K., Tokyo (JP); Sumitomo Pharma Co., Ltd., Osaka (JP)

(72) Inventors: Masakazu Inamori, Hyogo (JP); Dai Otagiri, Hyogo (JP)

(73) Assignees: HEALIOS K. K., Tokyo (JP); SUMITOMO PHARMA CO., LTD., Osaka (JP)

( * ) Notice: Subject to any disclaimer, the term of this patent is extended or adjusted under 35 U.S.C. 154(b) by 535 days.

(21) Appl. No.: 16/765,824

(22) PCT Filed: Nov. 27, 2018

(86) PCT No.: PCT/JP2018/043618
§ 371 (c)(1),
(2) Date: May 20, 2020

(87) PCT Pub. No.: WO2019/103160
PCT Pub. Date: May 31, 2019

(65) Prior Publication Data

US 2020/0352825 A1 Nov. 12, 2020

(30) Foreign Application Priority Data

Nov. 27, 2017 (JP) ..... 2017-227131

(51) Int. Cl.
*A61J 1/20* (2006.01)

(52) U.S. Cl.
CPC ..... *A61J 1/20* (2013.01)

(58) Field of Classification Search
CPC ..... A61J 1/2096; A61J 1/2048; A61J 1/2062; A61J 1/2089
See application file for complete search history.

(56) References Cited

U.S. PATENT DOCUMENTS 6,474,375 B2 * 11/2002 Spero ..... A61J 1/2089 604/416
8,469,939 B2 6/2013 Fangrow, Jr.
(Continued)

FOREIGN PATENT DOCUMENTS

JP 2007-509691 4/2007
JP 2013-226281 11/2013
(Continued)

*Primary Examiner* — Timothy P. Kelly
(74) *Attorney, Agent, or Firm* — Clark & Brody LP

(57) ABSTRACT

A cellular medicine transfer system includes: an adapter for a cellular medicine container including a first flow channel and a second flow channel through each of which a liquid and cells can flow; a cellular medicine container to which the adapter is attached, and in which a cellular medicine to be transferred is stored; an administration medium storage container that communicates with the first flow channel, and in which an administration medium is stored; a collection container for collecting a cellular medicine, that communicates with the second flow channel of the adapter; and a powering device that imparts motive power for transferring the administration medium from the administration medium storage container through the first flow channel to the cellular medicine container, and for transferring the cellular medicine and the administration medium from the cellular medicine container through the second flow channel to the collection container.

2 Claims, 8 Drawing Sheets

(56) References Cited

U.S. PATENT DOCUMENTS

| | | | | |
|---|---|---|---|---|
| 2007/0079894 | A1 | 4/2007 | Kraus et al. | |
| 2011/0087164 | A1* | 4/2011 | Mosler | A61J 1/2089 604/87 |
| 2011/0112501 | A1* | 5/2011 | Garfield | A61J 1/201 604/407 |
| 2011/0178493 | A1* | 7/2011 | Okiyama | A61J 1/2096 604/407 |
| 2012/0067429 | A1* | 3/2012 | Mosler | A61J 1/2075 137/551 |
| 2013/0269825 | A1 | 10/2013 | Osborn et al. | |
| 2015/0083950 | A1 | 3/2015 | Okiyama | |
| 2016/0256632 | A1 | 9/2016 | Fangrow | |
| 2021/0228446 | A1* | 7/2021 | Herrmann | A61J 1/2051 |
| 2022/0133594 | A1* | 5/2022 | Korogi | A61J 1/2075 604/416 |

FOREIGN PATENT DOCUMENTS

| | | |
|---|---|---|
| JP | 2014-504921 | 2/2014 |
| JP | 5509097 | 6/2014 |
| JP | 2017-501766 | 1/2017 |
| WO | 97/20536 | 6/1997 |

* cited by examiner

PRIOR ART

METHOD FOR TRANSFERRING CELLULAR MEDICINE USING A CELLULAR MEDICINE TRANSFER SYSTEM

TECHNICAL FIELD

The present invention relates to an adapter for a cellular medicine container and a multi-connection adapter for a cellular medicine container, as well as a cellular medicine transfer system and a transfer method which use the adapter for a cellular medicine container and the multi-connection adapter for a cellular medicine container. In particular, the present invention relates to an adapter for a cellular medicine container and a multi-connection adapter for a cellular medicine container which can be used in a closed transfer system for a cellular medicine and which are capable of reducing the amount of residue of a cellular medicine that was filled inside the cellular medicine container, and also to a cellular medicine transfer system and a transfer method that use the adapter for a cellular medicine container and the multi-connection adapter for a cellular medicine container.

BACKGROUND ART

Various closed transfer systems that are capable of transferring a medicine in a state in which contaminants from the external environment are prevented from mixing with the medicine have already been proposed.

A closed transfer system is a system that includes an adapter such as a vial adapter that is attachable to a medicine container such as a vial in which a medicine has been filled, and that takes out the medicine that is inside the medicine container to the outside through the adapter and transfers the medicine to another container.

For example, a vial adapter proposed in Patent Literature 1 may be mentioned as an example of the above kind of adapter.

The adapter disclosed in Patent Literature 1 includes one flow channel (an opening 24*a*) which a liquid (and air) can flow through, and another flow channel (an opening 24*b*) which only air can flow through, and has a structure such that it is possible to cause only a quantity of the medicine inside the vial that corresponds to a quantity of air that flowed into the vial through the other flow channel, to flow out to outside of the vial from the one flow channel (paragraph 0069 and the like of Patent Literature 1). A filter device for preventing contaminants from flowing into the vial is mounted in the other flow channel, and because the filter device is hydrophobic, liquid cannot flow through the other flow channel (only air can flow through the other flow channel) (paragraph 0070, 0107 and the like of Patent Literature 1).

In this connection, in recent years cellular medicines which have functions that closely resemble those of human tissue are attracting attention. It is necessary to prevent contaminants from the external environment from mixing with such cellular medicines, and it is considered that it is possible to apply a closed transfer system having a conventional adapter as disclosed in Patent Literature 1 for such a purpose.

However, in a case where the object to be transferred is a cellular medicine, cells are liable to precipitate and not uniformly diffuse in the liquid (preservation solution or the like). Therefore, if the conventional adapter is used, there is a problem that a residue occurs inside the vial. That is, in the case of a structure that causes only a quantity of a medicine inside a vial that corresponds to a quantity of air that flowed into the vial to flow out to the outside, as in the conventional adapter, there is a problem that cells adhere to the inner wall of the vial and are not transferred, and instead remain inside the vial.

In the case of a cellular medicine, the number of cells that are administered to a patient is important in terms of efficacy. However, if a residue occurs, there is a risk that the scheduled number of cells will not be administered to the patient and the anticipated efficacy will not be obtained.

Thus, in the case of cellular medicines, a residue that occurs in the transferring process is a greater problem than in the case of conventional medicines.

CITATION LIST

Patent Literature

[Patent Literature 1] JP5509097B

SUMMARY OF INVENTION

Technical Problem

An object of the present invention is to provide an adapter for a cellular medicine container and a multi-connection adapter for a cellular medicine container which can be used in a closed transfer system for a cellular medicine and which are capable of reducing the residue of a cellular medicine that was filled into a cellular medicine container, as well as to provide a cellular medicine transfer system and a transfer method which use the adapter for a cellular medicine container and the multi-connection adapter for a cellular medicine container.

Solution to Problem

To achieve the above object, the present inventors focused their attention on devising an adapter that is attachable to a cellular medicine container such as a vial in which a cellular medicine is filled. The present inventors carried out intensive studies repeatedly, and as a result discovered that the above object can be achieved by producing an adapter that includes two flow channels similarly to the conventional adapter, but which, unlike the conventional adapter, has a configuration in which the flow channels both allow a liquid and cells to flow therethrough.

The present invention was completed based on the above finding of the present inventors.

That is, to achieve the above object, the present invention provides an adapter for a cellular medicine container, the adapter being attachable to a cellular medicine container in which a cellular medicine is filled, comprising: a first flow channel and a second flow channel which, in a state in which the adapter is attached to the cellular medicine container, each have one end communicating with inside of the cellular medicine container, and each have another end communicating with outside of the cellular medicine container, wherein the first flow channel and the second flow channel both allow a liquid and cells to flow therethrough.

Note that, the adapter for a cellular medicine container according to the present invention can also be used as an adapter for a collection container and an administration medium storage container which constitute a cellular medicine transfer system according to the present invention to be described later. In the present description, the term "cellular medicine container" means a container in which a cellular medicine is filled (stored). Further, in the present description, the term "administration medium storage container" means a container in which an aqueous liquid in which cells are suspended, preferably a medium that is used when administering a cellular medicine to a living organism (in the present description, these are referred to generically as "administration medium"), is stored. In addition, in the present description, the term "collection container" means a container for collecting a cellular medicine.

Here, the phrase "it is possible for a liquid to flow through" means that it is possible for a liquid to flow from at least one side to the other side within the flow channels (first flow channel and second flow channel) that the adapter includes, and it need not necessarily be possible for the liquid to flow in both directions through the flow channels. That is, although a hydrophobic filter or the like that inhibits the flow of a liquid from both directions is not present in the flow channels of the adapter, a check valve or the like that inhibits the flow of the liquid from one side to the other side may be present in the flow channels.

Further, the phrase "it is possible for cells to flow through" means that the diameter of each flow channel of the adapter is greater than or equal to the diameter of the cells that are the object of the cellular medicine. It suffices that it is possible for cells to flow through the inside of the flow channels of the adapter at least from one side to the other side, and it need not necessarily be possible for the cells to flow in both directions through the flow channels. Specifically, the diameter of each flow channel of the adapter is 5 μm or more, and preferably is 10 μm, 20 μm, 50 μm, 100 μm or 200 μm or more (for example, 1 mm, 2 mm or 3 mm).

If the adapter according to the present invention is attached to a cellular medicine container, and a liquid such as an administration medium is caused to flow into the cellular medicine container from the first flow channel of the adapter, it is possible to cause a cellular medicine that is inside the cellular medicine container to flow out to outside of the cellular medicine container from the second flow channel in an amount that corresponds to the amount of liquid that flowed into the cellular medicine container. Specifically, for example, if a needle portion (denoted by reference numeral 13 in FIG. 1A) that includes one end of both the first flow channel and the second flow channel (ends denoted by reference character 11*a* and reference character 12*a* in FIG. 1A) of the adapter according to the present invention is inserted into a cellular medicine container, and a liquid such as an administration medium is caused to flow into the cellular medicine container from the other end (denoted by reference character 11*b* in FIG. 1A) of the first flow channel of the adapter, it is possible to cause the cellular medicine that is inside the cellular medicine container to flow out to outside (for example, to another cellular medicine container that is connected to the second flow channel of the adapter) of the cellular medicine container from the other end (denoted by reference character 12*b* in FIG. 1A) of the second flow channel in an amount that corresponds to the amount of liquid that flowed into the cellular medicine container. In the case of a cellular medicine, it is necessary to transfer the valuable cells without wasting any of the cells, and if a liquid is caused to flow into the cellular medicine container continuously and/or multiple times from the first flow channel, the inside of the cellular medicine container will be washed multiple times by the liquid that flowed into the cellular medicine container, and hence it will be possible to transfer a greater number of the cells that remain inside the cellular medicine container (for example, cells adhering to the inner wall of the cellular medicine container). Therefore, in comparison to a case that uses a conventional adapter which causes air to flow into a cellular medicine container, it is possible to reduce by a large margin the amount of residue of the cellular medicine inside the cellular medicine container. That is, when the adapter according to the present invention is used, since it is possible to cause an inflow of liquid into the cellular medicine container from the first flow channel and an outflow of the cellular medicine to outside of the cellular medicine container from the second flow channel to be repeatedly performed, the inside of the cellular medicine container is washed multiple times while maintaining the closed system by repeating the liquid inflow and outflow, and it is thus possible to reduce the amount of residue of the cellular medicine inside the cellular medicine container.

Note that, since it is possible for liquid and cells to flow through both the first flow channel and the second flow channel, naturally it is also possible for a gas (for example, air) to flow through each of these flow channels.

Preferably, the adapter further comprises a check valve which is provided in the first flow channel, and which prevents a flow of a liquid and cells from inside of the cellular medicine container to outside of the cellular medicine container through the first flow channel.

According to the preferable configuration described above, when causing a cellular medicine that is inside a cellular medicine container to which the adapter is attached to flow out to outside of the cellular medicine container from the second flow channel of the adapter, the risk of the cellular medicine flowing out (flowing back) to outside of the cellular medicine container from the first flow channel is eliminated, and it is thus possible to reliably cause the cellular medicine to flow out from the second flow channel.

Preferably, the adapter further comprises a check valve which is provided in the second flow channel, and which prevents a flow of a gas from outside of the cellular medicine container to inside of the cellular medicine container through the second flow channel.

According to the preferable configuration described above, when causing a liquid to flow from the first flow channel into the cellular medicine container to which the adapter is attached, the risk of a gas flowing into (flowing back to) the cellular medicine container from the second flow channel is eliminated, and it is thus possible to reliably cause the liquid to flow into the cellular medicine container.

To achieve the above object, the present invention also provides a multi-connection adapter for a cellular medicine container that comprises a plurality of the adapters for a cellular medicine container according to the present invention, wherein, among an adjacent pair of the adapters, the second flow channel of one of the adapters and the first flow channel of the other of the adapters are connected.

In the multi-connection adapter for a cellular medicine container according to the present invention, to prevent an outflow of liquid and cells to the outside of a cellular medicine transfer system according to the present invention to be described later, it is preferable to provide a check valve in flow channels that communicate with the outside of the cellular medicine transfer system, that are flow channels of the adapters located at both ends.

Although in the multi-connection adapter described above, each of the plurality of adapters is the adapter for a cellular medicine container according to the present invention, it is also possible to adopt a configuration in which a different adapter is provided at one end or both ends of the multi-connection adapter.

That is, to achieve the above object, the present invention further provides a multi-connection adapter for a cellular medicine container, comprising: at least one first adapter which is the adapter for a cellular medicine container according to the present invention; and one or two of a second adapter, which is an adapter comprising a first flow channel and a second flow channel which, in a state in which the second adapter is attached to an administration medium storage container in which an administration medium is stored or to a collection container for collecting the cellular medicine, each have one end communicating with inside of the administration medium storage container or inside of the collection container, and each have another end communicating with outside of the administration medium storage container or outside of the collection container, wherein among the first flow channel and the second flow channel of the second adapter, at least a flow channel that is connected to the first adapter allows a liquid and cells to flow therethrough; wherein the second adapter is located at one end or both ends, and among the first adapter and the second adapter, the first flow channel of one adapter and the second flow channel of the other adapter are connected.

As one aspect of the multi-connection adapter described above, a multi-connection adapter that can be mentioned as one example includes at least one first adapter (the adapter for a cellular medicine container according to the present invention), and one second adapter (a different adapter from the adapter for a cellular medicine container according to the present invention), in which the second adapter is located at one end of the multi-connection adapter.

Specifically, a dual-connection adapter in which a first flow channel of a first adapter and a second flow channel of a second adapter are connected, or a dual-connection adapter in which a second flow channel of a first adapter and a first flow channel of a second adapter are connected can be mentioned as examples of the multi-connection adapter. Further, as another specific example, a multi-connection adapter can be mentioned that includes two or more (for example, two, three, four or five) first adapters, in which, among an adjacent pair of first adapters, a second flow channel of one of the first adapters and a first flow channel of the other first adapter are connected, and a second adapter is connected to one end of these two or more consecutive first adapters. As mentioned above, the kind of the second adapter is not particularly limited as long as the second adapter includes two flow channels (a first flow channel and a second flow channel), and it is possible for liquid and cells to flow through at least one of the flow channels (flow channel connected to the first adapter). For example, as the second adapter, it is also possible to use a conventional adapter which includes one flow channel that it is possible for a liquid to flow through and another flow channel that it is possible for only air to flow through. With regard to the flow channel of the second adapter that is on the side which is not connected to the first adapter (flow channel which is open to the outside of the multi-connection adapter), in order to prevent an outflow of liquid to the outside of a cellular medicine transfer system (a cellular medicine transfer system according to the present invention to be described later), it is preferable that the flow channel in question is a flow channel in which a hydrophobic filter device or the like is mounted so that only air flows therethrough, or is a flow channel in which a check valve is provided. To prevent the mixing in of contaminants such as microbes from outside of the cellular medicine transfer system (cellular medicine transfer system according to the present invention to be described later), the flow channel is more preferably a flow channel in which a filter device is mounted, and for example a membrane filter is used as the filter device.

As another aspect of the multi-connection adapter described above, a multi-connection adapter that can be mentioned as an example includes, at a center part, at least one first adapter (the adapter for a cellular medicine container according to the present invention), and two second adapters (adapters that are different from the adapter for a cellular medicine container according to the present invention), in which the two second adapters are located at both ends of the multi-connection adapter, respectively.

Specifically, a three-connection adapter in which a first flow channel of the first adapter and a second flow channel of one of the second adapters are connected, and a second flow channel of the first adapter and a first flow channel of the other second adapter are connected can be mentioned as an example of the multi-connection adapter. Further, as another specific example, a multi-connection adapter can be mentioned that includes two or more (for example, two, three, four or five) first adapters, in which, among an adjacent pair of first adapters, a second flow channel of one of the first adapters and a first flow channel of the other first adapter are connected, with a second adapter being connected to both ends of these two or more consecutive first adapters. As mentioned above, the kind of the second adapter is not particularly limited as long as the second adapter includes two flow channels (a first flow channel and a second flow channel), and at least one of the flow channels (flow channel connected to the first adapter) allows a liquid and cells to flow therethrough. For example, as the second adapter, it is also possible to use a conventional adapter which includes one flow channel that it is possible for a liquid to flow through and another flow channel that it is possible for only air to flow through. With regard to the flow channel of the second adapter that is on the side which is not connected to the first adapter (flow channel which is open to the outside of the multi-connection adapter), in order to prevent an outflow of liquid to the outside of a cellular medicine transfer system (a cellular medicine transfer system according to the present invention to be described later), it is preferable that the flow channel in question is a flow channel in which a hydrophobic filter device or the like is mounted so that only air flows therethrough, or is a flow channel in which a check valve is provided. To prevent the mixing in of contaminants such as microbes from outside of the cellular medicine transfer system (cellular medicine transfer system according to the present invention to be described later), the flow channel is more preferably a flow channel in which a filter device is mounted, and for example a membrane filter is used as the filter device.

To achieve the above object, the present invention further provides a cellular medicine transfer system, comprising: the adapter for a cellular medicine container according to the present invention; the cellular medicine container to which the adapter is attached, and in which a cellular medicine to be transferred is stored; an administration medium storage container in which an administration medium is stored and which communicates with the first flow channel of the adapter; a collection container for collecting the cellular medicine, that communicates with the second flow channel of the adapter; and a powering device which imparts motive power for transferring the administration medium from the administration medium storage container to the cellular medicine container through the first flow channel, and for transferring the cellular medicine and the administration medium from the cellular medicine container to the collection container through the second flow channel.

According to the cellular medicine transfer system of the present invention, an administration medium is transferred to (caused to flow into) a cellular medicine container through the first flow channel of the adapter from an administration medium storage container, and the cellular medicine and the administration medium are transferred (caused to flow out) from the cellular medicine container to a collection container through the second flow channel of the adapter in an amount that corresponds to the amount of the administration medium that flowed into the cellular medicine container, by a powering device. As mentioned in the foregoing, if a liquid is caused to flow into the cellular medicine container continuously and/or multiple times from the first flow channel of the adapter, the inside of the cellular medicine container will be washed multiple times by the liquid that flowed into the cellular medicine container, and hence it will be possible to reduce the amount of residue of the cellular medicine inside the cellular medicine container by a large margin.

Note that, the cellular medicine transfer system according to the present invention can easily be configured as a closed transfer system by, for example: also attaching an adapter including a flow channel through which it is possible for a liquid and cells to flow to the administration medium storage container and to the collection container; connecting the adapter which is attached to the administration medium storage container and the first flow channel of the adapter according to the present invention that is attached to the cellular medicine container, through, for example, a known tube or connector; and connecting the adapter which is attached to the collection container and the second flow channel of the adapter according to the present invention that is attached to the cellular medicine container, through, for example, a known tube or connector.

Further, the cellular medicine and the administration medium can be transferred to the collection container simply and easily in a short time while maintaining the closed system of the transfer system without performing replacement of an adapter.

As the adapters to be attached to the administration medium storage container and the collection container, respectively, although the adapter according to the present invention may be used, the adapters to be attached to the administration medium storage container and the collection container are not limited thereto and it is also possible to use a conventional adapter (adapter including one flow channel through which it is possible for a liquid to flow, and another flow channel through which it is possible for only air to flow). In the case of using a conventional adapter as the adapters to be attached to the administration medium storage container and the collection container, respectively, it suffices to connect, for example through a known tube or connector, one flow channel (flow channel through which it is possible for a liquid to flow) of the adapter that is attached to the administration medium storage container, and the first flow channel of the adapter according to the present invention that is attached to a cellular medicine container, and to connect, for example through a known tube or connector, one flow channel (flow channel through which it is possible for a liquid to flow) of the adapter that is attached to the collection container, and the second flow channel of the adapter according to the present invention that is attached to the cellular medicine container.

To prevent an outflow of liquid to outside of the cellular medicine transfer system according to the present invention, with regard to a flow channel that is open to the outside of the adapters that are attached to the administration medium storage container and the collection container, respectively, it is preferable that the flow channel in question is a flow channel in which a hydrophobic filter device or the like is mounted so that only air flows therethrough, or is a flow channel in which a check valve is provided. To prevent the mixing in of contaminants such as microbes from outside, the flow channel is more preferably a flow channel in which a filter device is mounted, and for example a membrane filter is used as the filter device.

The kind of the powering device is not particularly limited as long as the powering device can impart motive power for transferring the administration medium from the administration medium storage container to the cellular medicine container, and transferring the content of the cellular medicine container to the collection container. A device that changes the pressure inside each container can be mentioned as an example of one aspect thereof. For example, it is possible to use a syringe as the powering device. Furthermore, for example, it is possible to impart motive power for transferring the administration medium and the cellular medicine by connecting a syringe to the adapter that is attached to the collection container, and using the syringe to suck air that is inside the collection container. Further, for example, it is possible to impart motive power for transferring the administration medium and the cellular medicine by connecting a syringe to the adapter that is attached to the administration medium storage container, and using the syringe to force air into the administration medium collection container. In addition, it is also possible to use as the powering device a syringe which itself also fulfills a function as an administration medium storage container. That is, it is also possible to impart motive power for transferring the administration medium and the cellular medicine by connecting a syringe to the first flow channel of the adapter according to the present invention that is attached to the cellular medicine container, and using the syringe to force the administration medium that is stored inside the syringe into the first flow channel.

In the cellular medicine transfer system according to the present invention, in a case where the adapter according to the present invention is also attached to the collection container, the second flow channel of the adapter that is attached to the cellular medicine container, and the first flow channel of the adapter that is attached to the collection container are connected.

As an example of a device for changing the pressure inside each container, a device that applies pressure to the cellular medicine container itself can be mentioned. For example, preferably, the cellular medicine container has flexibility, and by being deformed, fulfills a function as the powering device.

According to the preferable configuration described above, because the cellular medicine container fulfills a function as the powering device, there is no necessity to provide a powering device such as a syringe separately from the cellular medicine container, and it is thus possible to provide the transfer system with a simple configuration.

A container to be used as the cellular medicine container having flexibility is not particularly limited as long as the container is formed from a material having flexibility, and a container formed from a resin having flexibility can be mentioned as one example thereof. A resin that is known to persons skilled in the art can be appropriately used as the resin, as long as the container fulfills a function as the powering device. For example, a container formed from a resin such as polypropylene or polyethylene, polybutadiene, poly(vinyl chloride), ethylene vinyl acetate copolymer or silicone can be mentioned as an example of the cellular medicine container that is formed from a resin having flexibility.

Further, as an example of a device for changing the pressure inside each container, a device that applies pressure to the administration medium storage container itself can be mentioned. For example, preferably, the administration medium storage container has flexibility, and by being deformed, fulfills a function as the powering device.

According to the preferable configuration described above also, because the administration medium storage container fulfills a function as the powering device, there is no necessity to provide a powering device such as a syringe separately from the administration medium storage container, and it is thus possible to provide the transfer system with a simple configuration.

Preferably, the cellular medicine transfer system according to the present invention comprises a plurality of the adapters that are attached to the cellular medicine containers; and a plurality of the cellular medicine containers of a same number as the adapters; wherein, among an adjacent pair of the adapters, the second flow channel of one of the adapters and the first flow channel of the other of the adapters are connected.

According to the preferable configuration described above, a cellular medicine that is stored in a plurality of cellular medicine containers can be transferred together to a collection container. Therefore, by adjusting the number of cellular medicine containers, it is possible to easily adjust the number of cells that are collected (number of cells administered to the patient) to a desired value.

To achieve the above object, the present invention further provides a cellular medicine transfer method (first method) for transferring a cellular medicine using the cellular medicine transfer system according to the present invention, including: a first step in which the administration medium storage container is disposed so that a side of the administration medium storage container that is a side communicating with the first flow channel is located at the bottom, the cellular medicine container is disposed so that a side of the cellular medicine container that is a side at which the adapter is attached is located at the top, and the administration medium is transferred from the administration medium storage container through the first flow channel to the cellular medicine container using the powering device; and a second step in which the administration medium storage container is disposed so that a side of the administration medium storage container that is a side communicating with the first flow channel is located at the top, the cellular medicine container is disposed so that a side of the cellular medicine container that is a side at which the adapter is attached is located at the bottom, and the cellular medicine and the administration medium are transferred from the cellular medicine container through the second flow channel to the collection container using the powering device.

According to the first method for transferring a cellular medicine according to the present invention, in the first step, it is possible to transfer the administration medium that flows out from a lower part of the administration medium storage container into the cellular medicine container from an upper part of the cellular medicine container through the first flow channel of the adapter. At such time, air inside the cellular medicine container is transferred to the collection container through the second flow channel of the adapter from the upper part of the cellular medicine container.

Subsequently, in the second step, it is possible to transfer the cellular medicine and the administration medium that flow out from a lower part of the cellular medicine container to the collection container through the second flow channel of the adapter. At such time, air inside the administration medium storage container is transferred into the cellular medicine container through the first flow channel of the adapter from a lower part of the cellular medicine container.

It is preferable to repeat the first step and the second step to thereby wash the inside of the cellular medicine container multiple times.

According to the first method for transferring a cellular medicine according to the present invention, by executing the first step and the second step in sequence, it is possible to easily transfer a cellular medicine that is inside a cellular medicine container to a collection container without exposing the cellular medicine to external contaminants. Further, according to the first transfer method, in the first step, the inside of the cellular medicine container is washed by the transferred administration medium, and it is thus possible to significantly reduce the amount of residue of the cellular medicine inside the cellular medicine container.

To achieve the above object, the present invention further provides a cellular medicine transfer method (second method) for transferring a cellular medicine using the cellular medicine transfer system according to the present invention, wherein: the administration medium storage container is disposed so that a side of the administration medium storage container that is a side communicating with the first flow channel is located at the bottom, the cellular medicine container is disposed so that a side of the cellular medicine container that is a side at which the adapter is attached is located at the bottom, and using the powering device, the administration medium is transferred from the administration medium storage container through the first flow channel to the cellular medicine container, and the cellular medicine and the administration medium are transferred from the cellular medicine container through the second flow channel to the collection container.

According to the second method for transferring a cellular medicine of the present invention, it is possible to transfer the administration medium that flows out from a lower part of the administration medium storage container into the cellular medicine container from a lower part of the cellular medicine container through the first flow channel of the adapter. Simultaneously therewith, it is possible to transfer the cellular medicine and the administration medium that flow out from a lower part of the cellular medicine container to the collection container through the second flow channel of the adapter.

According to the second method for transferring a cellular medicine of the present invention, even without executing a first step and a second step in sequence as in the first method for transferring a cellular medicine, it is possible to transfer a cellular medicine that is inside a cellular medicine container to a collection container without exposing the cellular medicine to external contaminants, more easily and in a short time by a single operation. Further, according to the second transfer method, the inside of the cellular medicine container is washed by the transferred administration medium, and it is possible to significantly reduce the amount of residue of the cellular medicine inside the cellular medicine container. It is also possible to repeat the second transfer method multiple times.

In the second method for transferring a cellular medicine of the present invention, preferably, the cellular medicine container has flexibility, and by returning the cellular medicine container to an original state from a deformed state, the administration medium is transferred from the administration medium storage container through the first flow channel to the cellular medicine container, and by deforming the cellular medicine container, the cellular medicine and the administration medium are transferred from the cellular medicine container through the second flow channel to the collection container.

According to the aforementioned preferable method, by returning the cellular medicine container from a deformed state to its original state (for example, by the fingers of an operator which had been pinching and squeezing the cellular medicine container being released), a suction force will act because the capacity of the cellular medicine container increases, and the administration medium will thus be transferred from the administration medium storage container to the cellular medicine container through the first flow channel in an amount corresponding to the increased capacity. Further, by deforming the cellular medicine container (for example, by the cellular medicine container being pinched and squeezed by the fingers of an operator), the capacity of the cellular medicine container decreases, and hence the cellular medicine and the administration medium will be transferred from the cellular medicine container to the collection container through the second flow channel in an amount that corresponds to the decreased capacity.

According to the preferable method described above, since it suffices to merely deform the cellular medicine container (and to return the cellular medicine container to its original state), it is possible to transfer the cellular medicine from inside the cellular medicine container to the collection container extremely easily and in a short time. Further, in the preferable method described above also, it is possible to reduce the amount of residue of the cellular medicine inside the cellular medicine container by a large margin. It is also possible to repeat the above preferable method multiple times.

To summarize the foregoing description, the present invention relates to the following matters.

[1] An adapter for a cellular medicine container, the adapter being attachable to a cellular medicine container in which a cellular medicine is filled, comprising:

a first flow channel and a second flow channel which, in a state in which the adapter is attached to the cellular medicine container, each have one end communicating with inside of the cellular medicine container, and each have another end communicating with outside of the cellular medicine container, wherein the first flow channel and the second flow channel both allow a liquid and cells to flow therethrough.

[2] The adapter for a cellular medicine container according to [1], further comprising:

a check valve which is provided in the first flow channel, and which prevents a flow of a liquid and cells from inside of the cellular medicine container to outside of the cellular medicine container through the first flow channel.

[3] The adapter for a cellular medicine container according to [1] or [2], further comprising:

a check valve which is provided in the second flow channel, and which prevents a flow of a gas from outside of the cellular medicine container to inside of the cellular medicine container through the second flow channel.

[4] A multi-connection adapter for a cellular medicine container that comprises a plurality of the adapters for a cellular medicine container according to any one of [1] to [3], wherein, among an adjacent pair of the adapters, the second flow channel of one of the adapters and the first flow channel of the other of the adapters are connected.

[5] A multi-connection adapter for a cellular medicine container, comprising:

at least one first adapter which is the adapter for a cellular medicine container according to any one of [1] to [3]; and one or two of a second adapter, which is an adapter comprising a first flow channel and a second flow channel which, in a state in which the second adapter is attached to an administration medium storage container in which an administration medium is stored or to a collection container for collecting the cellular medicine, each have one end communicating with inside of the administration medium storage container or inside of the collection container, and each have another end communicating with outside of the administration medium storage container or outside of the collection container, wherein among the first flow channel and the second flow channel of the second adapter, at least a flow channel that is connected to the first adapter allows a liquid and cells to flow therethrough;

wherein the second adapter is located at one end or both ends, and among the first adapter and the second adapter, the first flow channel of one adapter and the second flow channel of the other adapter are connected.

[6] A cellular medicine transfer system, comprising:

the adapter for a cellular medicine container according to any one of [1] to [3];

the cellular medicine container to which the adapter is attached, and in which a cellular medicine to be transferred is stored;

an administration medium storage container in which an administration medium is stored and which communicates with the first flow channel of the adapter;

a collection container for collecting the cellular medicine, that communicates with the second flow channel of the adapter; and a powering device which imparts motive power for transferring the administration medium from the administration medium storage container to the cellular medicine container through the first flow channel, and for transferring the cellular medicine and the administration medium from the cellular medicine container to the collection container through the second flow channel.

[7] The cellular medicine transfer system according to [6], wherein:

the adapter is attached to the collection container, and the second flow channel of the adapter that is attached to the cellular medicine container, and the first flow channel of the adapter that is attached to the collection container are connected.

[8] The cellular medicine transfer system according to [6] or [7], wherein:

the cellular medicine container has flexibility, and by being deformed, fulfills a function as the powering device.

[9] The cellular medicine transfer system according to any one of [6] to [8], wherein:

the administration medium storage container has flexibility, and by being deformed, fulfills a function as the powering device.

[10] The cellular medicine transfer system according to any one of [6] to [9], comprising:

a plurality of the adapters that are attached to the cellular medicine containers; and a plurality of the cellular medicine containers of a same number as the adapters;

wherein, among an adjacent pair of the adapters, the second flow channel of one of the adapters and the first flow channel of the other of the adapters are connected.

[11] A cellular medicine transfer method for transferring a cellular medicine using the cellular medicine transfer system according to any one of [6] to [10], including:

a first step in which the administration medium storage container is disposed so that a side of the administration medium storage container that is a side communicating with the first flow channel is located at the bottom, the cellular medicine container is disposed so that a side of the cellular medicine container that is a side at which the adapter is attached is located at the top, and the administration medium is transferred from the administration medium storage container through the first flow channel to the cellular medicine container using the powering device; and a second step in which the administration medium storage container is disposed so that a side of the administration medium storage container that is a side communicating with the first flow channel is located at the top, the cellular medicine container is disposed so that a side of the cellular medicine container that is a side at which the adapter is attached is located at the bottom, and the cellular medicine and the administration medium are transferred from the cellular medicine container through the second flow channel to the collection container using the powering device.

[12] A cellular medicine transfer method for transferring a cellular medicine using the cellular medicine transfer system according to any one of [6] to [10], wherein:

the administration medium storage container is disposed so that a side of the administration medium storage container that is a side communicating with the first flow channel is located at the bottom, the cellular medicine container is disposed so that a side of the cellular medicine container that is a side at which the adapter is attached is located at the bottom, and using the powering device, the administration medium is transferred from the administration medium storage container through the first flow channel to the cellular medicine container, and the cellular medicine and the administration medium are transferred from the cellular medicine container through the second flow channel to the collection container.

[13] The cellular medicine transfer method according to [12], wherein:

the cellular medicine container has flexibility, and by returning the cellular medicine container to an original state from a deformed state, the administration medium is transferred from the administration medium storage container through the first flow channel to the cellular medicine container, and by deforming the cellular medicine container, the cellular medicine and the administration medium are transferred from the cellular medicine container through the second flow channel to the collection container.

Advantageous Effects of Invention

According to the present invention, it is possible to provide an adapter for a cellular medicine container which can be used in a closed transfer system for a cellular medicine and which is capable of reducing the amount of residue of a cellular medicine that was filled inside a cellular medicine container, and to also provide a cellular medicine transfer system and a transfer method which use the adapter for a cellular medicine container.

DESCRIPTION OF EMBODIMENTS

Hereunder, one embodiment of the present invention is described with reference being made as appropriate to the attached drawings.

Figure 1A:
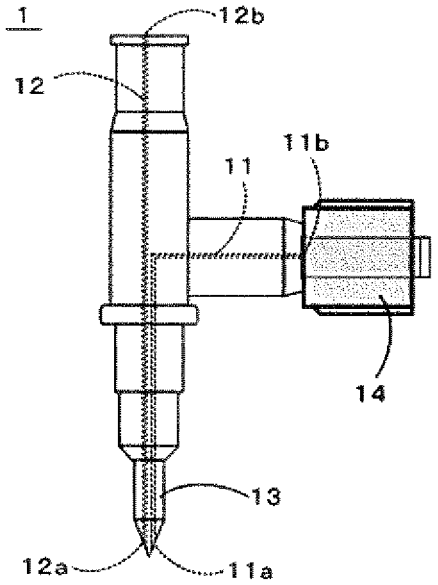
FIGS. 1A and 1B are views which illustrate schematic configuration examples of an adapter for a cellular medicine container according to one embodiment of the present invention.
Figure 1B:
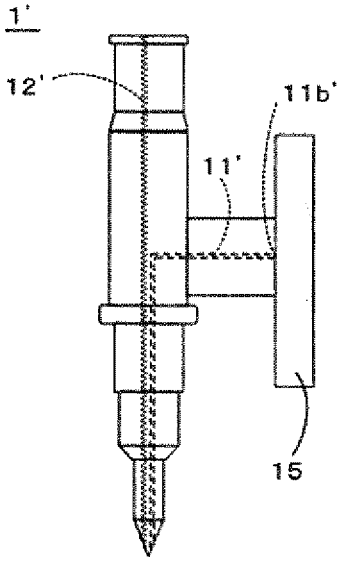

FIGS. 1A and 1B are views illustrating schematic configuration examples of an adapter for a cellular medicine container (hereunder, where appropriate, abbreviated to "adapter") according to one embodiment of the present invention. FIG. 1A illustrates a schematic configuration example of an adapter according to the present embodiment, and FIG. 1B illustrates a schematic configuration example of a conventional adapter for reference purposes.

As illustrated in FIG. 1A, an adapter 1 according to the present embodiment includes a first flow channel 11 and a second flow channel 12.

In a state in which the adapter 1 is attached to a cellular medicine container (not illustrated) such as a vial in which a cellular medicine is filled (a state in which a needle portion 13 with which the adapter 1 is equipped is inserted into the cellular medicine container), one end 11*a* (end on the side on which the needle portion 13 is located) of the first flow channel 11 communicates with the inside of the cellular medicine container, and another end 11*b* of the first flow channel 11 communicates with the outside of the cellular medicine container.

Similarly, in the state in which the adapter 1 is attached to the cellular medicine container, one end (end on the side on which the needle portion 13 is located) 12*a* of the second flow channel 12 communicates with the inside of the cellular medicine container, and another end 12*b* of the second flow channel 12 communicates with the outside of the cellular medicine container.

Note that, the adapter 1 according to the present embodiment may be equipped with a luer lock 14 on the other end 11*b* side of the first flow channel 11 and/or the other end 12*b* side of the second flow channel 12 (in the example illustrated in FIG. 1A, the adapter 1 is equipped with the luer lock 14 on the other end 11*b* side of the first flow channel 11). By means of the luer lock 14, it is possible to easily connect the first flow channel 11 and/or the second flow channel 12 and a tube (not illustrated) that extends to outside of the cellular medicine container.

A conventional adapter 1' illustrated in FIG. 1B includes a similar first flow channel 11' and second flow channel 12'. However, the conventional adapter 1' is equipped with a hydrophobic filter device 15 on the other end 11*b*' of the first flow channel 11'. Therefore, the conventional adapter 1' has a configuration in which a liquid does not flow through the first flow channel 11'.

In contrast, because the adapter 1 according to the present embodiment illustrated in FIG. 1A has a configuration which is not equipped with the filter device 15 (configuration from which the filter device 15 provided in the conventional adapter 1' has been removed), it is possible for a liquid to flow through the first flow channel 11, and not just the second flow channel 12. Further, it is also possible for cells and air, and not just a liquid, to flow through the first flow channel 11 and the second flow channel 12.

Note that it is also possible to provide a check valve in the first flow channel 11 and the second flow channel 12 to prevent the transfer of liquid and cells in an unintended direction.

Figure 2A:
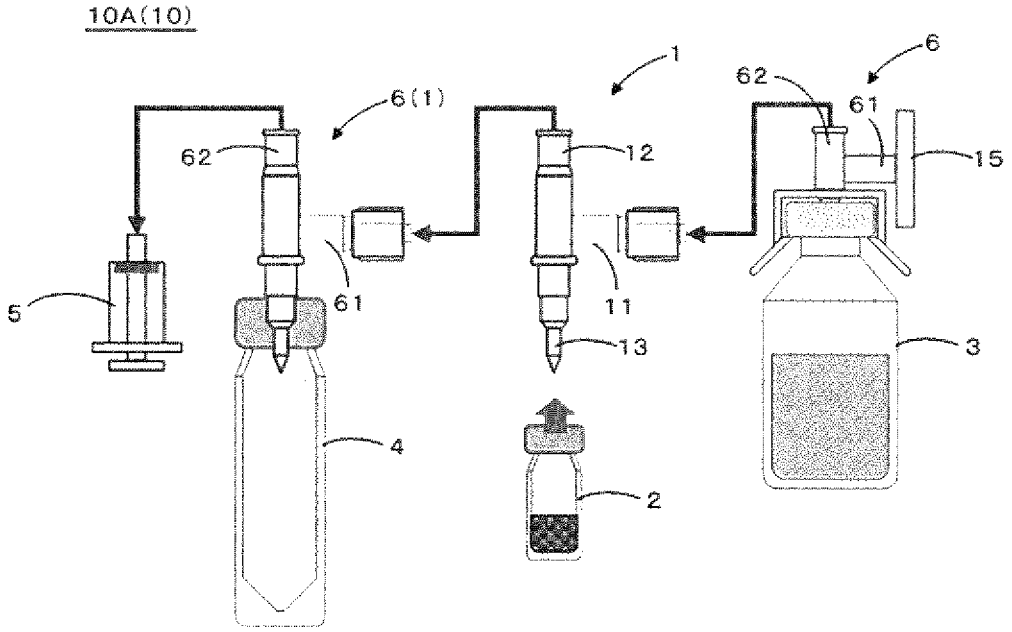
FIGS. 2A and 2B are views which illustrate schematic configuration examples of cellular medicine transfer systems that use the adapters illustrated in FIGS. 1A and 1B.
Figure 2B:
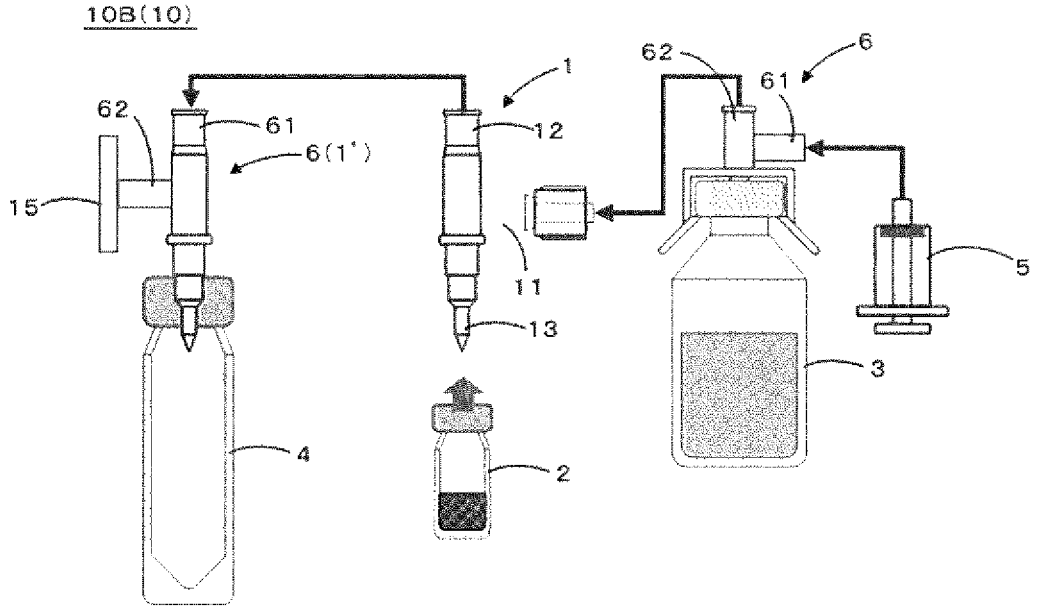

FIGS. 2A and 2B are view illustrating schematic configuration examples of cellular medicine transfer systems that use the adapter 1 according to the present embodiment that is described above (hereunder, where appropriate, referred to as "first adapter 1"). FIG. 2A illustrates an example of a cellular medicine transfer system equipped with a powering device on a collection container side, and FIG. 2B illustrates an example of a cellular medicine transfer system equipped with a powering device on an administration medium storage container side.

As illustrated in FIGS. 2A and 2B, a cellular medicine transfer system (hereunder, where appropriate, abbreviated to "transfer system") 10 (10A, 10B) according to the present embodiment includes the first adapter 1 and second adapters 6, a cellular medicine container 2, an administration medium storage container 3, a collection container 4 and a powering device 5. The first adapter 1 is attached to the cellular medicine container 2 (FIGS. 2A and 2B illustrate a state before the first adapter 1 is attached to the cellular medicine container 2). On the other hand, the second adapters 6 are attached to the administration medium storage container 3 and the collection container 4, respectively. Note that, the kind of each second adapter 6 is not particularly limited as long as each second adapter 6 includes two flow channels (a first flow channel and a second flow channel) and at least one flow channel (the flow channel that is connected to the first adapter) allows a liquid and cells to flow therethrough. For example, it is possible to use the adapter 1 according to the present embodiment or the conventional adapter 1' as the second adapter 6. In the case of the transfer system 10A illustrated in FIG. 2A, the second adapter 6 that is attached to the collection container 4 is the adapter 1 according to the present embodiment (Therefore, in FIG. 2A, the reference numeral of the second adapter 6 that is attached to the collection container 4 is "6(1)". The same applies hereunder.). Further, in the case of the transfer system 10A illustrated in FIG. 2A, the second adapter 6 that is attached to the administration medium storage container 3 is a different kind of adapter to the adapter 1 according to the present embodiment and the conventional adapter 1'. In the case of the transfer system 10B illustrated in FIG. 2B, the second adapter 6 that is attached to the collection container 4 is the conventional adapter 1' (Therefore, in FIG. 2B, the reference numeral of the second adapter 6 that is attached to the collection container 4 is "6(1')". The same applies hereunder.). Further, in the case of the transfer system 10B illustrated in FIG. 2B, the second adapter 6 that is attached to the administration medium storage container 3 is a different kind of adapter to the adapter 1 according to the present embodiment and the conventional adapter 1'. However, none of the second adapters 6 are limited to the adapters illustrated in FIGS. 2A and 2B, and as mentioned above it suffices that at least one flow channel (the flow channel connected to the first adapter) allows a liquid and cells to flow therethrough.

Note that, with regard to the flow channel that is open to the outside of the transfer systems 10A and 10B of each second adapter 6, in order to prevent an outflow of liquid to the outside it is preferable that the flow channel that is open to the outside is a flow channel in which a hydrophobic filter device 15 or the like is mounted and through which only air flows, or is a flow channel in which a check valve is provided. To prevent the mixing in of contaminants such as microbes from outside, as illustrated in FIGS. 2A and 2B, the flow channel is preferably a flow channel in which the filter device 15 is mounted, and for example a membrane filter or the like is used as the filter device 15.

The cellular medicine that is to be transferred is stored in the cellular medicine container 2, and the first adapter 1 is attached to the cellular medicine container 2. Although, for example, a vial made of glass is used as the cellular medicine container 2 of the present embodiment, the cellular medicine container 2 is not particularly limited as long as it is a container for storing a cellular medicine.

The administration medium is stored in the administration medium storage container 3, and the administration medium storage container 3 communicates with the first flow channel 11 included in the first adapter 1. Specifically, a second flow channel 62 through which it is possible for a liquid and cells to flow of the second adapter 6 that is attached to the administration medium storage container 3 is directly connected to the first flow channel 11 of the first adapter 1, or for example is connected to the first flow channel 11 of the first adapter 1 through a known tube or connector (not illustrated).

The collection container 4 is a container (for example, a vial) for collecting the cellular medicine, and communicates with the second flow channel 12 included in the first adapter 1.

Specifically, in the case of the transfer system 10A illustrated in FIG. 2A, the second flow channel 12 included in the first adapter 1 that is attached to the cellular medicine container 2, and a first flow channel 61 included in the second adapter 6 that is attached to the collection container 4 are directly connected, or for example are connected through a known tube or connector (not illustrated).

Further, in the case of the transfer system 10B illustrated in FIG. 2B, the second flow channel 12 included in the first adapter 1 that is attached to the cellular medicine container 2, and the first flow channel 61 included in the second adapter 6 that is attached to the collection container 4 are directly connected, or for example are connected through a known tube or connector (not illustrated).

Although the collection container 4 is not particularly limited as long as it is a container that is suitable for collecting a cellular medicine, preferably the shape of the collection container 4 and the raw material of which the collection container 4 is made are suitable for operations that are performed after collection of the cellular medicine. Since performing centrifugation after collection of the cellular medicine may be mentioned as an example of one aspect of such operations, preferably the collection container 4 is a container such as a vial that was manufactured using a raw material capable of withstanding centrifugation, and is a shape such that the collection container 4 can be placed in a commercially available centrifugal machine.

The powering device 5 imparts motive power for transferring the administration medium from the administration medium storage container 3 to the cellular medicine container 2 through the first flow channel 11, and transferring the cellular medicine and the administration medium from the cellular medicine container 2 to the collection container 4 through the second flow channel 12. The kind of the powering device 5 is not particularly limited as long as the powering device 5 can impart motive power for transferring the administration medium and the cellular medicine, and in the example illustrated in FIGS. 2A and 2B a syringe is used as the powering device 5.

In the case of the transfer system 10A illustrated in FIG. 2A, the powering device 5 is provided on the collection container 4 side. Specifically, the second flow channel 62 of the second adapter 6 that is attached to the collection container 4, and the powering device 5 are directly connected, or for example are connected through a known tube or connector (not illustrated). By sucking out air from inside the collection container 4 with the syringe that is the powering device 5, it is possible to impart motive power for transferring the administration medium and the cellular medicine. The specific transfer method will be described later.

In the case of the transfer system 10B illustrated in FIG. 2B, the powering device 5 is provided on the administration medium storage container 3 side. Specifically, the first flow channel 61 of the second adapter 6 that is attached to the administration medium storage container 3, and the powering device 5 are directly connected, or for example are connected through a known tube or connector (not illustrated). By forcing air into the administration medium storage container 3 using a syringe that is the powering device 5, it is possible to impart motive power for transferring the administration medium and the cellular medicine.

Hereunder, an example of a method for transferring a cellular medicine using the transfer system 10A illustrated in FIG. 2A is described.

Figure 3A:
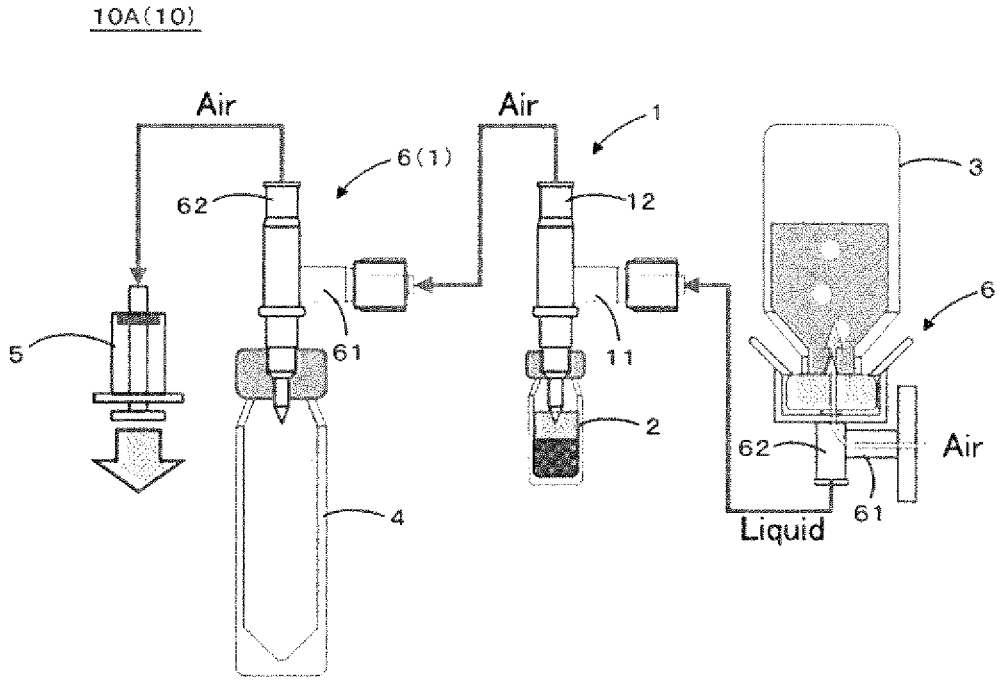
FIGS. 3A and 3B are explanatory drawings for describing a first transfer method for transferring a cellular medicine using the cellular medicine transfer system illustrated in FIG. 2A.
Figure 3B:
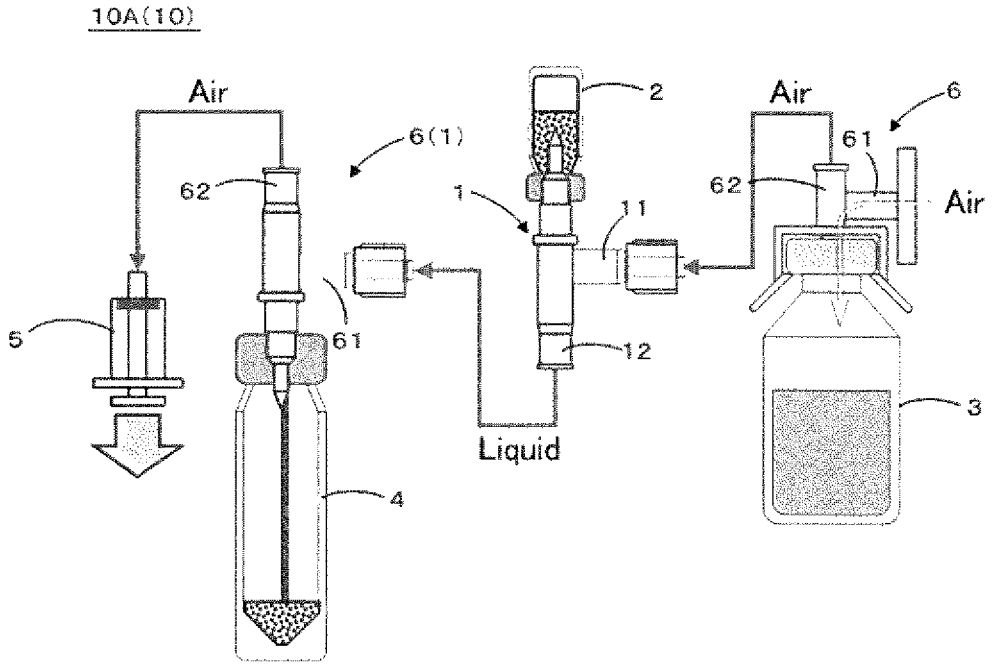

FIGS. 3A and 3B are explanatory drawings for describing a first transfer method for transferring a cellular medicine using the transfer system 10A illustrated in FIG. 2A. The first transfer method illustrated in FIGS. 3A and 3B includes a first step illustrated in FIG. 3A and a second step illustrated in FIG. 3B.

As illustrated in FIG. 3A, in the first step, the administration medium storage container 3 is disposed so that a side of the administration medium storage container 3 which is the side communicating with the first flow channel 11 of the first adapter 1 is located at the bottom (so that the side at which the second adapter 6 is attached is the bottom side). In other words, the administration medium storage container 3 is disposed so that the base of the administration medium storage container 3 that is a part to which the second adapter 6 is not attached is located at the top. Further, the cellular medicine container 2 is disposed so that a side of the cellular medicine container 2 that is the side at which the first adapter 1 is attached is located at the top. in other words, the cellular medicine container 2 is disposed so that the base of the cellular medicine container 2 that is a part at which the first adapter 1 is not attached is located at the bottom side of the cellular medicine container 2. When the administration medium storage container 3 and the cellular medicine container 2 are disposed in this state, if air inside the collection container 4 is sucked out by the syringe that is the powering device 5, air inside the cellular medicine container 2 that communicates with the collection container 4 will also be sucked out. In the first step, an amount of the administration medium that corresponds to the amount of air sucked out from inside the cellular medicine container 2 is transferred from the administration medium storage container 3 to the cellular medicine container 2 through the first flow channel 11 of the first adapter 1 that is attached to the cellular medicine container 2.

Note that, depending on the capacity of the syringe that is the powering device 5, before executing the second step it is preferable to push out air from inside the syringe to thereby restore the syringe to a state in which it is possible for the syringe to suck in air once again in the second step. The air that is pushed out from the syringe is discharged to outside from the first flow channel 61 of the second adapter 6 that is attached to the administration medium storage container 3.

As illustrated in FIG. 3B, in the second step, the administration medium storage container 3 is disposed so that a side of the administration medium storage container 3 which is the side that communicates with the first flow channel 11 of the first adapter 1 is located at the top (so that the side at which the second adapter 6 is attached is the upper side). In other words, the administration medium storage container 3 is disposed so that the base of the administration medium storage container 3 that is a part at which the second adapter 6 is not attached is located at the bottom. Further, the cellular medicine container 2 is disposed so that a side of the cellular medicine container 2 which is the side at which the first adapter 1 is attached is located at the bottom. In other words, the cellular medicine container 2 is disposed so that the base of the cellular medicine container 2 that is a part at which the first adapter 1 is not attached is located at the top. When the administration medium storage container 3 and the cellular medicine container 2 are disposed in this state, if air inside the collection container 4 is sucked out by the syringe that is the powering device 5, an amount of the cellular medicine and the administration medium that corresponds to the amount of air sucked out from inside the collection container 4 is transferred from inside the cellular medicine container 2 to the collection container 4 through the second flow channel 12 of the first adapter 1 that is attached to the cellular medicine container 2.

According to the first transfer method described above, by executing the first step illustrated in FIG. 3A and the second step illustrated in FIG. 3B in sequence, it is possible to easily transfer the cellular medicine from inside the cellular medicine container 2 to the collection container 4. Further, according to the first transfer method, in the first step, because the administration medium is transferred into the cellular medicine container 2 to dilute the cellular medicine, and the inside of the cellular medicine container 2 is also washed by the transferred administration medium, it is possible to reduce the amount of residue of the cellular medicine in the cellular medicine container 2 by a large margin.

Note that, in the first transfer method, it is preferable to repeatedly execute the first step illustrated in FIG. 3A and the second step illustrated in FIG. 3B in sequence. By rinsing the cellular medicine container 2 multiple times, it is possible to reduce the amount of residue of the cellular medicine in the cellular medicine container 2 by a large margin.

Figure 4:
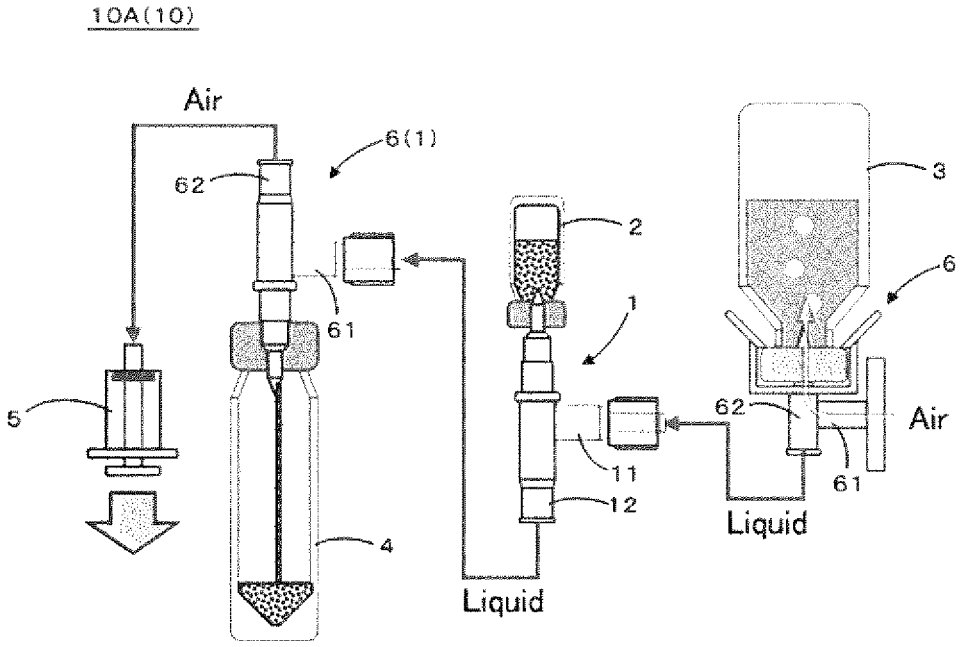
FIG. 4 is an explanatory drawing for describing a second transfer method for transferring a cellular medicine using the transfer system illustrated in FIG. 2A.

FIG. 4 is an explanatory drawing for describing a second transfer method for transferring a cellular medicine using the transfer system 10A illustrated in FIG. 2A.

As illustrated in FIG. 4, in the second transfer method, the administration medium storage container 3 is disposed so that a side of the administration medium storage container 3 which is the side communicating with the first flow channel 11 of the first adapter 1 is located at the bottom (so that the side at which the second adapter 6 is attached is the bottom side). In other words, the administration medium storage container 3 is disposed so that the base of the administration medium storage container 3 that is a part at which the second adapter 6 is not attached is located at the top. Further, the cellular medicine container 2 is disposed so that a side of the cellular medicine container 2 that is the side at which the first adapter 1 is attached is located at the bottom. In other words, the cellular medicine container 2 is disposed so that base of the cellular medicine container 2 that is a part at which the first adapter 1 is not attached is located at the top. When the administration medium storage container 3 and the cellular medicine container 2 are disposed in this state, if air inside the collection container 4 is sucked out by the syringe that is the powering device 5, an amount of the administration medium that corresponds to the amount of air sucked out from inside the collection container 4 is transferred from the administration medium storage container 3 to the cellular medicine container 2 through the first flow channel 11 of the first adapter 1 which is attached to the cellular medicine container 2, and furthermore the cellular medicine and the administration medium is transferred from inside the cellular medicine container 2 to the collection container 4 through the second flow channel 12 of the first adapter 1 that is attached to the cellular medicine container 2.

According to the second transfer method that is described above, even without repeating the first step and second step in sequence as in the first transfer method, it is possible to more easily transfer the cellular medicine from inside the cellular medicine container 2 to the collection container 4 by a single operation. Further, according to the second transfer method, because the administration medium is transferred into the cellular medicine container 2, the inside of the cellular medicine container 2 is washed by the transferred administration medium, and it is thus possible to reduce the amount of residue of the cellular medicine in the cellular medicine container 2 by a large margin.

Note that, in the second transfer method also, it is preferable to repeatedly execute the step illustrated in FIG. 4. By rinsing the cellular medicine container 2 multiple times, it is possible to reduce the amount of residue of the cellular medicine in the cellular medicine container 2 by a large margin. Depending on the capacity of the syringe that is the powering device 5, it is preferable to push out air from inside the syringe to thereby restore the syringe to a state in which it is possible for the syringe to suck in air once again. By this means, the second transfer method can be repeated irrespective of the capacity of the syringe. The air that is pushed out from the syringe is discharged to outside from the first flow channel 61 of the second adapter 6 that is attached to the administration medium storage container 3.

Although in the above description a case in which the transfer system 10A illustrated in in FIG. 2A is taken as an example, it is also possible to transfer the cellular medicine in the cellular medicine container 2 to the collection container 4 by a similar method when using the transfer system 10B illustrated in FIG. 2B. Further, because the inside of the cellular medicine container 2 is washed by the administration medium that is transferred from the administration medium storage container 3, it is possible to reduce the amount of residue of the cellular medicine in the cellular medicine container 2 by a large margin.

Hereunder, modifications of the cellular medicine transfer system which uses the adapter 1 according to the present embodiment are described.

Figure 5:
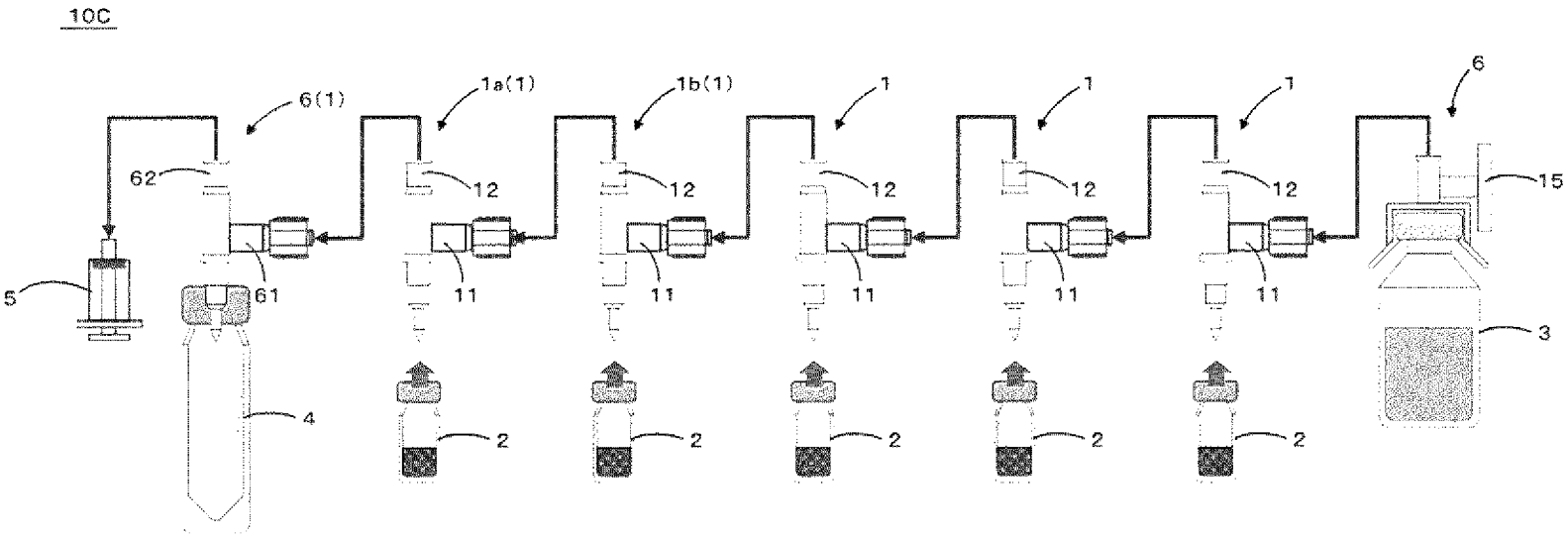
FIG. 5 is a view illustrating a schematic configuration of a cellular medicine transfer system according to a modification.

FIG. 5 is a view that illustrates the schematic configuration of a transfer system 10C according to a modification.

As illustrated in FIG. 5, unlike the transfer system 10A illustrated in FIG. 2A, the transfer system 10C includes a plurality (five in the example illustrated in FIG. 5) of the first adapters 1 that are to be attached to the cellular medicine containers 2, and a plurality (five in the example illustrated in FIG. 5) of the cellular medicine containers 2 that are of the same number as the first adapter 1 (in FIG. 5, a state before the first adapters 1 are attached to the cellular medicine containers 2 is illustrated). Among an adjacent pair of the adapters 1 (for example, adapters 1*a* and 1*b*), the second flow channel 12 of one of the adapters 1 (1*b*) and the first flow channel 11 of the other adapter 1 (1*a*) are connected.

According to the transfer system 10C, cellular medicines that are stored in a plurality of the cellular medicine containers 2 can be transferred together to the collection container 4. Therefore, by adjusting the number of the cellular medicine containers 2, it is possible to easily adjust the number of cells that are collected (number of cells to be administered to the patient) to a desired value.

Figure 6A:
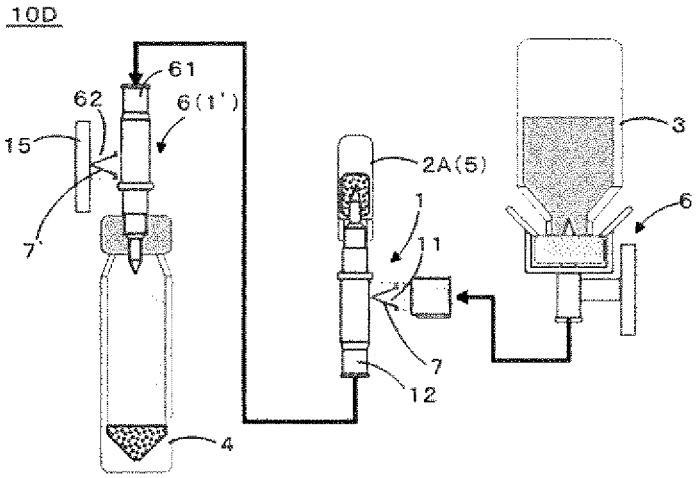
FIGS. 6A to 6C are views illustrating schematic configurations of transfer systems according to other modifications.
Figure 6B:
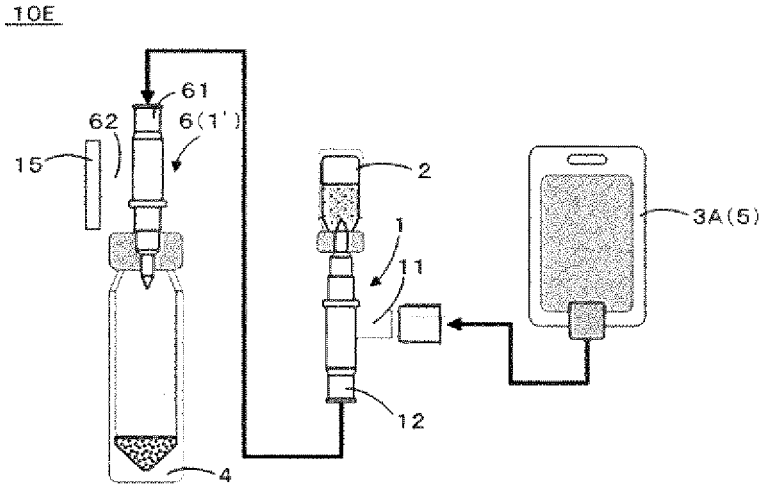
Figure 6C:
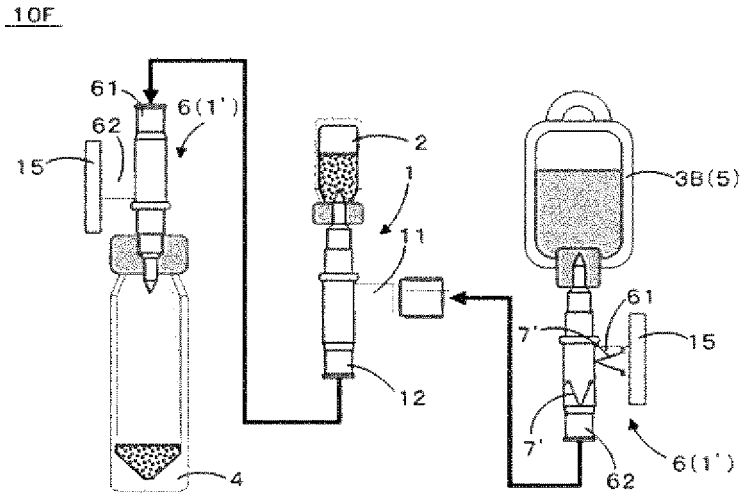

FIGS. 6A to 6C are views that illustrate schematic configurations of transfer systems 10D, 10E and 10F according to other modifications.

As illustrated in FIG. 6A, unlike the cellular medicine container 2 made of glass that is illustrated in FIG. 2 and FIG. 5, a cellular medicine container 2A which the transfer system 10D includes is formed from a resin such as polypropylene or polyethylene and has flexibility. When the cellular medicine container 2A that has flexibility is deformed, the cellular medicine container 2A fulfills a function as the powering device 5.

Further, the transfer system 10D is equipped with a check valve 7 which is provided in the first flow channel 11 of the first adapter 1 that is attached to the cellular medicine container 2A, and which prevents the flow of liquid and cells from the inside of the cellular medicine container 2A to outside of the cellular medicine container 2A (from the left side to the right side in FIG. 6A). The transfer system 10D is also equipped with a check valve 7' which is provided in the second flow channel 62 of the second adapter 6(1'), and which prevents the flow of air from outside the collection container 4 to inside the collection container 4 (from the left side to the right side in FIG. 6A).

The type of check valve to be used as the check valves 7 and 7' is not particularly limited, and for example it is possible to use a membrane-type check valve or a duckbill-type check valve. The check valves 7 and 7' may be check valves of the same type or may be check valves of different types to each other.

Whilst in the transfer system 10D illustrated in FIG. 6A the cellular medicine container 2A that has flexibility fulfills a function as the powering device 5, in the transfer system 10E illustrated in FIG. 6B, an administration medium storage container 3A has flexibility, and by being deformed, the administration medium storage container 3A fulfills a function as the powering device 5. Similarly, in the transfer system 10F illustrated in FIG. 6C, an administration medium storage container 3B has flexibility, and by being deformed, the administration medium storage container 3B fulfills a function as the powering device 5.

As illustrated in FIG. 6B, the administration medium storage container 3A included in the transfer system 10E is a medical solution bag having flexibility that is formed from a resin such as poly(vinyl chloride) or ethylene vinyl acetate copolymer. The administration medium storage container 3A fulfills a function as the powering device 5 when the administration medium storage container 3A is deformed. In particular, the administration medium storage container 3A is a soft bag on which a restoring force does not act (bag does not return to its original state from a deformed state) in a case where the administration medium storage container 3A was deformed.

The administration medium storage container 3A which the transfer system 10E includes is connected directly to the first adapter, and is not connected thereto by way of the second adapter 6.

As illustrated in FIG. 6C, the administration medium storage container 3B which the transfer system 10F includes is a medical solution bag having flexibility that is formed from a resin such as polyethylene or polypropylene. Similarly to the administration medium storage container 3A, when deformed, the administration medium storage container 3B having flexibility fulfills a function as the powering device 5. However, unlike the administration medium storage container 3A, the administration medium storage container 3B is a bag with hardness on which a restoring force acts (the bag returns to its original shape from a deformed state) in a case where the administration medium storage container 3B was deformed.

Further, the transfer system 10F includes a check valve 7 which is provided in the second flow channel 62 of the second adapter 6 that is attached to the administration medium storage container 3B, and which prevents the flow of liquid and cells from outside of the administration medium storage container 3B to inside of the administration medium storage container 3B. The transfer system 10F also includes a check valve 7' which is provided in the first flow channel 61 of the second adapter 6 that is attached to the administration medium storage container 3B, and which prevents the flow of liquid or air from inside the administration medium storage container 3B to outside of the administration medium storage container 3B.

Hereunder, an example of a method for transferring a cellular medicine using the transfer system 10D illustrated in FIG. 6A is described.

Figure 7A:
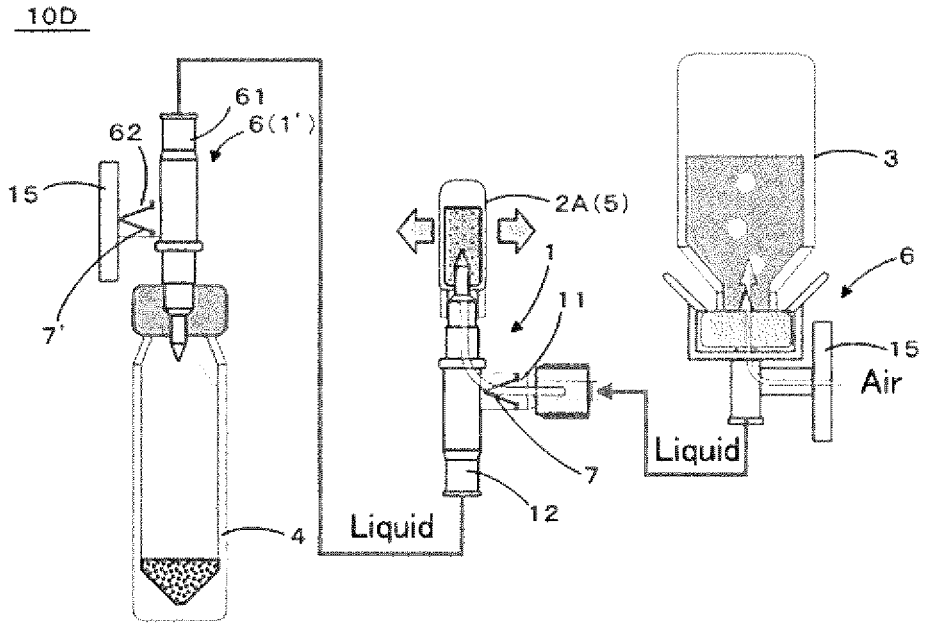
FIGS. 7A and 7B are explanatory drawings for describing transfer methods that transfer a cellular medicine using the transfer systems illustrated in FIG. 6.
Figure 7B:
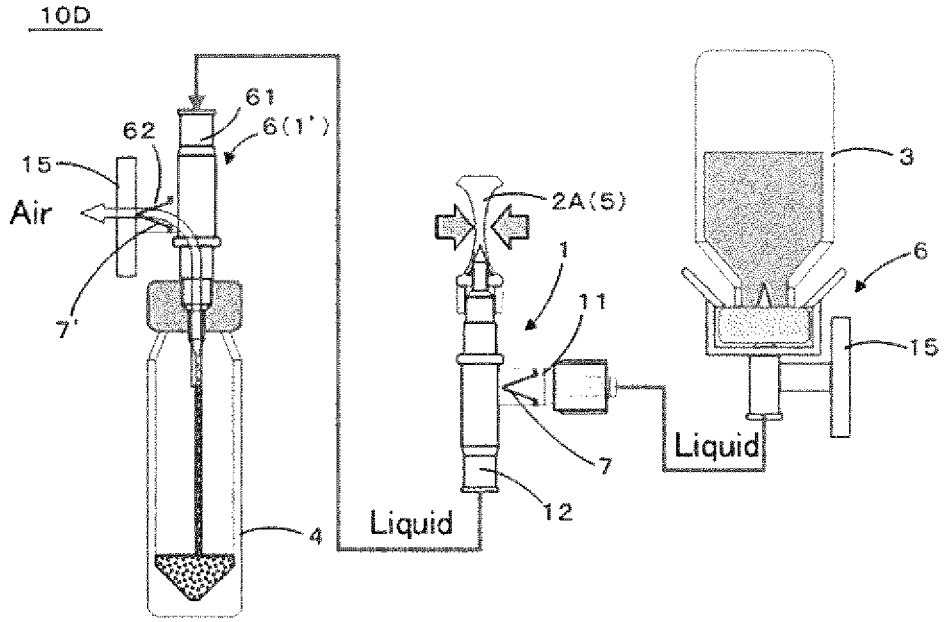

FIGS. 7A and 7B are explanatory drawings for describing a transfer method for transferring a cellular medicine using the transfer system 10D illustrated in FIG. 6A.

In the transfer method using the transfer system 10D, as illustrated in FIG. 7A, the cellular medicine container 2A is restored from a deformed state to its original state (for example, the fingers of an operator which had being pinching and squeezing the cellular medicine container 2A are released). As a result, a suction force acts because the capacity of the cellular medicine container 2A increases, and an amount of the administration medium that corresponds to the amount of increased capacity is transferred from the administration medium storage container 3 to the cellular medicine container 2A through the first flow channel 11 of the first adapter 1.

At such time, unless the check valve 7' is provided in the second flow channel 62 of the second adapter 6 that is attached to the collection container 4, there is a risk that air from outside of the collection container 4 will flow (flow back) into the collection container 4 through the filter device 15 of the second adapter 6, and air will flow (flow back) into the cellular medicine container 2A through the first flow channel 61 of the second adapter 6 and the second flow channel 12 of the first adapter 1. There is a risk that, as a result, the administration medium would not be sufficiently transferred to the cellular medicine container 2A from the administration medium storage container 3. However, in the transfer system 10D, because the check valve 7' is provided in the second flow channel 62 of the second adapter 6, there is no risk of a backflow of air occurring as described above, and the administration medium can be sufficiently transferred from the administration medium storage container 3 to the cellular medicine container 2A.

Next, in the transfer method using the transfer system 10D, as illustrated in FIG. 7B, the cellular medicine container 2A is deformed (for example, the cellular medicine container 2A is pinched and squeezed by fingers of an operator). As a result, since the capacity of the cellular medicine container 2A decreases, an amount of the cellular medicine and administration medium inside the cellular medicine container 2A that corresponds to the decreased amount of capacity is transferred from the cellular medicine container 2A to the collection container 4 through the second flow channel 12 of the first adapter 1.

At such time, unless the check valve 7 is provided in the first flow channel 11 of the first adapter 1 that is attached to the cellular medicine container 2A, there is a risk that the cellular medicine and administration medium will flow out (flow back) from the first flow channel 11 of the first adapter 1 into the administration medium storage container 3. There is a risk that, as a result, the cellular medicine will not be sufficiently transferred from the cellular medicine container 2A to the collection container 4. However, in the transfer system 10D, because the check valve 7 is provided in the first flow channel 11 of the first adapter 1, there is no risk of a backflow of the cellular medicine and administration medium occurring as described above, and the cellular medicine can be sufficiently transferred to the collection container 4.

By repeating the operations illustrated in FIG. 7A and FIG. 7B that are described above one time or, as necessary, multiple times, the cellular medicine inside the cellular medicine container 2A is transferred to the collection container 4.

According to the transfer method that uses the transfer system 10D described above, since it suffices to merely deform the cellular medicine container 2A (and restore the cellular medicine container 2A to its original shape), it is possible to transfer the cellular medicine that is inside the cellular medicine container 2 to the collection container 4 extremely easily. Further, since the administration medium is transferred into the cellular medicine container 2A, the inside of the cellular medicine container 2A is washed by means of the transferred administration medium, and it is thus possible to reduce the amount of residue of the cellular medicine inside the cellular medicine container 2A by a large margin.

Figure 8:
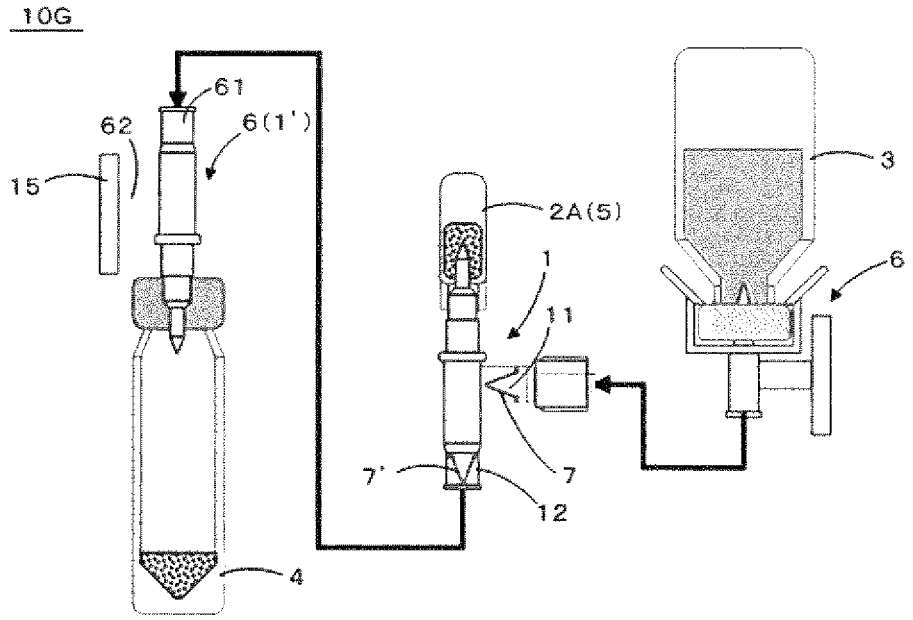
FIG. 8 is a view illustrating the schematic configuration of a transfer system according to another modification.

Note that, although the transfer system 10D has a configuration in which the check valve 7' that prevents the flow of air from outside of the collection container 4 into the inside of the collection container 4 is provided in the second flow channel 62 of the second adapter 6, the transfer system of the present invention is not limited to the aforementioned configuration, and it is also possible to provide the check valve 7' at the same position as in the configuration of a transfer system 10G illustrated in FIG. 8.

That is, the transfer system 10G illustrated in FIG. 8 includes a check valve 7' which is provided in the second flow channel 12 of the first adapter 1 and which prevents the flow of a gas into the cellular medicine container 2A from outside of the cellular medicine container 2A through the second flow channel 12.

According to the transfer system 10G, when the administration medium is caused to flow into the cellular medicine container 2A that is attached to the first adapter 1 from the first flow channel 11, there is no risk of a gas flowing (flowing back) into the cellular medicine container 2A from the second flow channel 12, and it is thus possible to cause the administration medium to reliably flow into the cellular medicine container 2A.

Although a transfer method of the present invention is described above taking a method for transferring a cellular medicine using the transfer system 10D as an example, in the case of using the transfer system 10E or 10F it suffices to transfer the administration medium from the administration medium storage container 3A or 3B to the cellular medicine container 2 by deforming the administration medium storage container 3A or 3B (for example, by an operator pinching and squeezing the administration medium storage container 3A or 3B with their fingers).

The transfer system according to the present invention is not limited in any way by the transfer systems 10, 10A, 10B, 10C, 10D, 10E, 10F and 10G described above, and various modifications are possible.

For example, although in the transfer system 10A illustrated in FIG. 2A, the syringe as the powering device 5 is connected to the collection container 4 (connected to the second adapter 6 that is attached to the collection container 4), the present invention is not limited thereto. It is also possible to provide a syringe as the powering device 5 between the collection container 4 and the cellular medicine container 2 (between the second adapter 6 that is attached to the collection container 4, and the first adapter 1 that is attached to the cellular medicine container 2), or between the cellular medicine container 2 and the administration medium storage container 3 (between the first adapter 1 that is attached to the cellular medicine container 2, and the second adapter 6 that is attached to the administration medium storage container 3). Further, by pushing and pulling the syringe, the administration medium can be transferred from the administration medium storage container 3 to the cellular medicine container 2, and the administration medium and the cellular medicine can be transferred from the cellular medicine container 2 to the collection container 4.

However, in a case where, as described above, the powering device 5 is provided between the collection container 4 and the cellular medicine container 2 or between the cellular medicine container 2 and the administration medium storage container 3, it is preferable to provide similar check valves to the check valves 7 and T illustrated in FIG. 6A so that liquid, cells and air do not flow back from the collection container 4 toward the cellular medicine container 2, or to provide similar check valves to the check valves 7 and 7' illustrated in FIG. 6C so that liquid, cells and air do not flow back from the cellular medicine container 2 toward the administration medium storage container 3.

Further, although in the transfer system 10C illustrated in FIG. 5, the plurality of cellular medicine containers 2 are taken as being vials that are made of glass, for example, it is also possible to adopt a configuration in which all or some of the plurality of cellular medicine containers 2 of the transfer system are replaced with the cellular medicine container 2A having flexibility that is illustrated in FIG. 6. In this case, since the cellular medicine containers 2A that replace the cellular medicine containers 2 fulfill a function as the powering device 5, it is possible to remove the syringes as the powering device 5 that are illustrated in FIG. 5.

In addition, in a case where the administration medium storage container 3 and the collection container 4 can be connected to the first adapter 1 directly without being connected by way of the second adapter 6, the second adapter 6 is unnecessary. Specifically, with respect to the transfer system 10 and the like, an example can be mentioned in which a container having flexibility (for example, a medical solution bag) is used as the administration medium storage container 3 (for example, the administration medium storage container 3A illustrated in FIG. 6B). In this case, a general injection needle or the like, and not the second adapter 6, can be used for connecting the administration medium storage container 3.

REFERENCE SIGNS LIST

1, 1', 6 Adapter
2, 2A Cellular Medicine Container
3 Administration Medium Storage Container
4 Collection Container
5 Powering Device
7 Check Valve
11, 11' First Flow Channel
12, 12' Second Flow Channel
15 Filter Device
10, 10A, 10B, 10C, 10D, 10E, 10F, 10G Transfer System

The invention claimed is:

1. A cellular medicine transfer method for transferring a cellular medicine using a cellular medicine transfer system, wherein the cellular medicine transfer system comprises:

an adapter for a cellular medicine container, the adapter being attachable to a cellular medicine container in which a cellular medicine is filled in advance, the adapter comprising a first flow channel and a second flow channel, in a state in which the adapter is attached to the cellular medicine container, the first flow channel and the second flow channel having one end communicating with inside of the cellular medicine container, and the first flow channel and the second flow channel having another end communicating with outside of the cellular medicine container, the first flow channel and the second flow channel both allowing a liquid and cells to flow therethrough, and the first flow channel and the second flow channel being different flow channels each other;

the cellular medicine container to which the adapter is attached, and which stores a cellular medicine to be transferred;

an administration medium storage container which stores an administration medium and which communicates with the first flow channel of the adapter;

a collection container for collecting the cellular medicine, that communicates with the second flow channel of the adapter; and a powering device which imparts motive power for transferring the administration medium from the administration medium storage container to the cellular medicine container through the first flow channel, and for transferring the cellular medicine and the administration medium from the cellular medicine container to the collection container through the second flow channel, and wherein the cellular medicine transfer method comprises:

disposing the administration medium storage container so that a side of the administration medium storage container that is a side communicating with the first flow channel is located downward;

disposing the cellular medicine container so that a side of the cellular medicine container that is a side at which the adapter is attached is located downward; and transferring the administration medium from the administration medium storage container through the first flow channel to the cellular medicine container using the powering device, and transferring the cellular medicine and the administration medium from the cellular medicine container through the second flow channel to the collection container using the powering device.

2. The cellular medicine transfer method according to claim 1, wherein the cellular medicine container has flexibility, and wherein the cellular medicine transfer method comprises transferring the administration medium from the administration medium storage container through the first flow channel to the cellular medicine container by returning the cellular medicine container to an original state from a deformed state; and transferring the cellular medicine and the administration medium from the cellular medicine container through the second flow channel to the collection container by deforming the cellular medicine container.

* * * * *